United States Patent [19]

Klingaman

[11] 3,966,089

[45] June 29, 1976

[54] DILUTING AND DISPENSING CONTAINER

[75] Inventor: Richard James Klingaman, Darien, Conn.

[73] Assignee: Colgate-Palmolive Company, New York, N.Y.

[22] Filed: Apr. 25, 1975

[21] Appl. No.: 571,886

[52] U.S. Cl. ..... 222/88

[51] Int. Cl.[2] ..... B67B 7/24

[58] Field of Search ..... 222/83.5, 86, 88, 85; 206/222; 220/20; 215/6, DIG. 8

[56] References Cited

UNITED STATES PATENTS

| | | | |
|---|---|---|---|
| 2,536,221 | 1/1951 | Rector et al. | 222/88 |
| 3,024,947 | 3/1962 | Jeynes | 222/83.5 |
| 3,506,157 | 4/1970 | Dukess | 222/94 |
| 3,655,096 | 4/1972 | Easter | 222/82 |

*Primary Examiner*—Robert B. Reeves
*Assistant Examiner*—John P. Shannon
*Attorney, Agent, or Firm*—Herbert S. Sylvester; Murray M. Grill; Kenneth A. Koch

[57] ABSTRACT

A diluting and dispensing container having a neck portion for receiving and puncturing the bottom of a capsule of concentrated material. The capsule has an annular storage compartment, a central passageway and a frangible bottom wall.

6 Claims, 9 Drawing Figures

FIG. 1
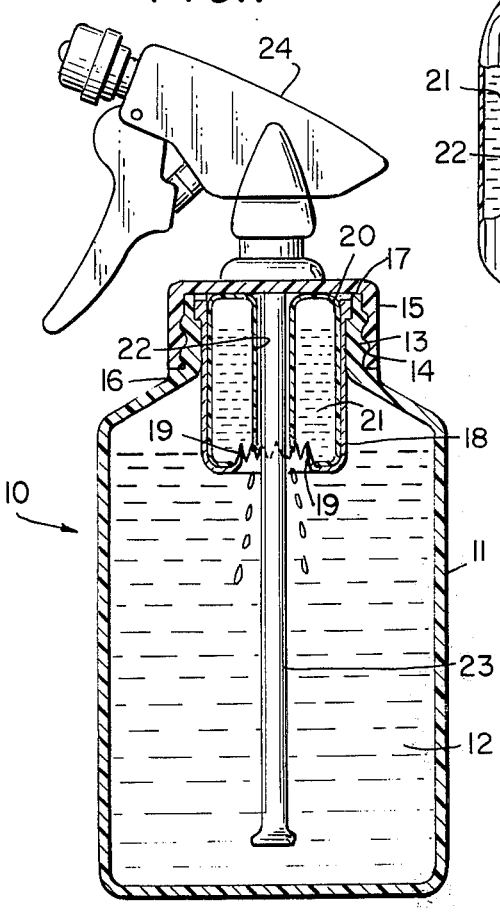
FIG. 2
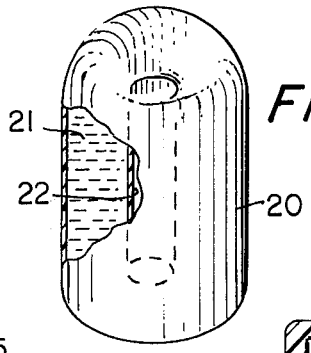
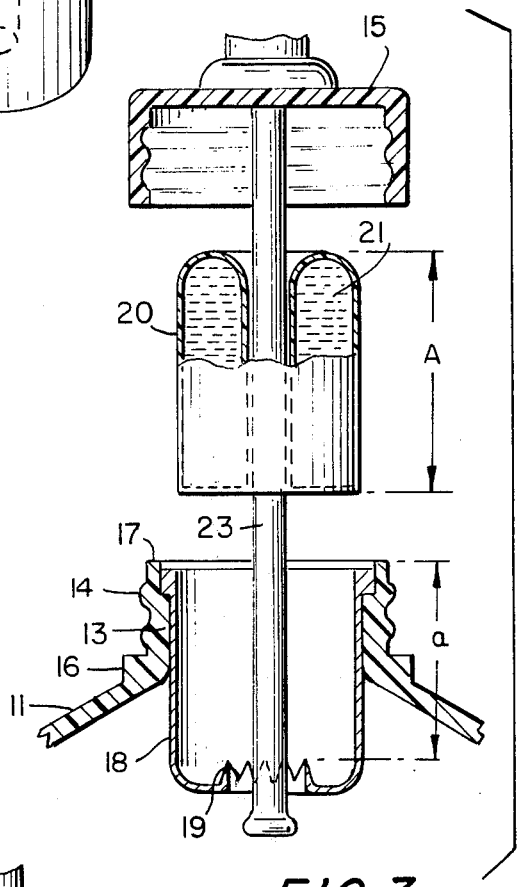
FIG. 3
FIG. 4
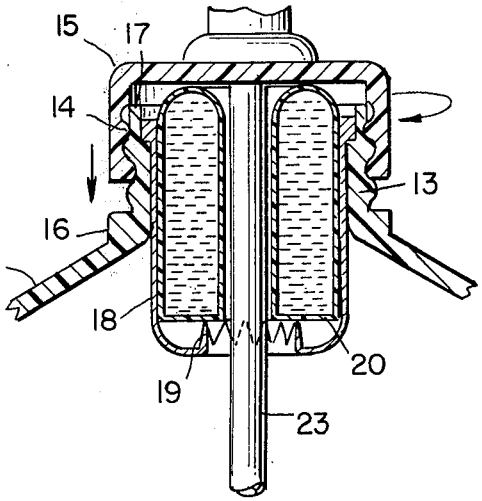

DILUTING AND DISPENSING CONTAINER

BACKGROUND OF THE INVENTION

The invention pertains to a container for combining at least two separate components of a multi-component system that are combined before use and subsequently dispensed together as a functional solution. More specifically, the invention provides a reuseable dispensing container having means for combining a concentrated material, typically a liquid, with a liquid diluent, such as water. The concentrated material is supplied in a separately packaged capsule that is easily inserted into and removed from the reuseable dispensing container. After the combined solution of concentrated material and diluent is used, the spent capsule is removed and replaced by a fresh capsule. Diluent is resupplied to the container and the two components are combined to form a fresh supply of the functional solution.

In many instances it is desirable to retain the components of a multi-component system separate and to combine them shortly before use. This is true of systems wherein the components are incompatible either with each other or the packing material, as well as when it is desired to supply the consumer with a concentrated substance which can be diluted, typically with water, to form a functional solution.

The present invention provides a dispenser and capsule of a concentrated substance for use in conjunction with the dispenser to combine the concentrated substance with a diluent material to form a functional solution. Typical of the concentrated substances useable according to the invention are detergents that can be subsequently diluted with water to form a detergent solution of the proper concentration for use as a window cleaner, spot remover, disinfectant cleanser for hard surfaces, i.e., tubs and tile cleaners, wall cleaners, etc.

Dispensers for combining the components of a multicomponent system shortly before use can be classified into two distinct groups. The first group are those employing reuseable containers that can be recharged with a fresh capsule of concentrate when the functional solution is expended and a second group wherein the container and capsule of concentrate are designed for a single use and subsequent disposal. In the second group, the capsule of concentrate is typically permanently contained within the container and/or dispenser.

Representative of the first class of container-dispensers is the device disclosed in the Easter U.S. Pat. No. 3,655,096. The Easter patent describes a dispensing system employing a replaceable capsule containing a concentrated liquid material in combination with a bottle and a dip tube-dispensing pump device. The capsule has frangible upper and lower surfaces and an annular flange extending from its upper surface. The capsule is placed in the neck of the bottle and supported by the annular flange resting on the rim of the container neck. The dip tube passes through the cartridge by puncturing both its top and bottom surfaces. The concentrate then flows into the body of the bottle where it mixes with a diluent, such as water, resulting in the final functional solution. The resulting solution is dispensed by activating the pump mechanism to upwardly draw the solution through the dip tube and to expel it from a dispensing orifice in the pump head.

The second class of multicomponent container dispensers includes the devices disclosed in the Jeynes Jr. U.S. Pat. No. 3,024,947, the Smith U.S. Pat. No. 2,653,611 and the Schwartman U.S. Pat. No. 3,347,410. The Jeynes Jr. patent discloses a squirt bottle of the foregoing type wherein the concentrated material is present in a ring shaped aluminum foil cartridge. The concentrate cartridge is placed on a supporting flange located within the neck of the bottle. A closure cap having a dispensing orifice, a dip tube and an annular row of teeth extending downwardly is provided in the Jeynes Jr. system. The upper surface of the concentrate cartridge is punctured by the annular row of teeth when the closure cap is pressed downwardly thereby releasing the concentrate into the diluent contained in the body of the bottle. The resulting solution is expelled through the dip tube and the dispensing orifice by squeezing pressure applied to the bottle, which has flexible plastic walls.

The Schwartzman and Smith patents both provide compartments disposed in the bottle neck for holding a powdered component separate from a liquid diluent in the body of the bottle. A plunger means is provided in the closure cap for combining the powdered component and the diluent in response to downward pressure on the plunger. In Schwartzman the plunger operates through a bellows and displaces the bottom wall of the powder compartment while in Smith the plunger forces the entire compartment into the body of the bottle.

SUMMARY OF THE INVENTION

The dispensing container of the invention includes a bottle, container or other hollow vessel having a body for containing a liquid diluent and a reduced diameter neck portion having supported therein a cradle with puncturing means extending upwardly therefrom. The cradle can be contained entirely within the neck portion of the bottle or can extend partially into the body portion of the bottle.

The capsule for containing the concentrate substance can have a ring or doughnut shaped cross sectional configuration with an annular concentrate storage compartment and a central passageway. The bottom wall of the capsule is of a frangible material and thickness adapted to be pierced or ruptured by the puncturing means in response to a downward force applied to the capsule while it is in place on the cradle and resting on the puncturing means.

A closure cap including a dispensing means, typically a pump or simply an orifice, is provided. The closure cap includes means to mate with the neck portion of the bottle to provide a tight seal between the two members. A dip tube communicating with the dispensing means can be associated with the closure cap. The length of the dip tube is chosen so that it terminates a short distance above the bottom of the body portion of the bottle. Alternately, the combined diluent and concentrate solution can be dispensed through the central passageway of the capsule and a dispensing orifice in response to finger pressure applied to the sides of the flexible wall bottle i.e. a squirt bottle. In this latter embodiment a dip tube may not be used since the central passageway of the capsule forms a suitable conduit for the solution to pass from the body of the bottle to the dispensing orifice.

The closure cap is joined to the neck portion of the bottle usually by screwing it onto the neck and, if present, the dip tube passes through the central passageway of the capsule and into the body of the bottle. Before the closure cap is fully seated on the neck of the container, an inner surface of the top of the cap contacts the upper surface of the capsule. The additional application of downward axial force to seat the closure cap forces the capsule downward against the puncturing means until the frangible bottom of the capsule is pierced and the concentrate flows into the diluent contained in the body of the bottle to form the desired functional solution. The solution is dispensed from the bottle through the dip tube and the dispensing orifice as a spray or a stream of liquid either in response to activation of a hand pump associated with the closure cap or finger pressure applied to the sides of the flexible wall of the body portion of the bottle.

In accordance with a specific aspect of the invention, the concentrate capsule is of a predetermined height dimension, measured parallel to the axis of the central passageway. The predetermined height dimension of the capsule is greater than the distance from the upper terminus of the puncturing means to the upper rim of the neck portion of the bottle. Accordingly, when the capsule is placed inside the neck portion and rests in the cradle on the puncturing means, a portion of the capsule extends beyond the upper rim of the neck portion of the bottle and projects from the container.

In further accordance with an important specific aspect of the invention, the predetermined height dimension of the capsule is so chosen so that the top surface of the capsule is above the rim of the neck portion of the container after the closure cap is fully seated and the bottom of the capsule is punctured. The distance of projection for the capsule beyond the rim of the neck portion of the container after the closure cap is fully seated should be sufficient to permit the capsule to be grasped between the fingers and withdrawn from the container. This feature of the invention allows the user of the dispenser-container to readily remove and dispose of a spent capsule since the projecting portion of the capsule can be grasped by the user. By providing a capsule with a frangible bottom and appropriate puncturing means in the neck of the container, the new dispenser-container avoids possible splashback of the concentrate onto the user when the capsule is punctured, as might be the case with prior art systems of this type employing a replaceable cartridge that is punctured at the top as well as the bottom.

A primary advantage of the new dispenser-container is the economic savings realized by the manufacturing, packaging, bulk storage and shipping cost of a concentrate solution rather than a dilute solution of active substances such as detergents. A further advantage is the reuseability of the new container and dispensing mechanism with a multitude of capsules containing different types of concentrated active ingredients. A still further advantage of the invention is the provision of a container-dispenser of the foregoing type wherein the concentrate capsules are easily insertable and removable and do not interfere with the closure joint between the container and closure cap. A still further advantage of the new container is the elimination of possible back splashing of the concentrate solution out of the capsule when the concentrate and diluent are combined. Additional advantages of the invention will become apparent from the following description.

BRIEF DESCRIPTION OF THE DRAWINGS

The invention and preferred embodiments thereof will now be described in further detail with reference to the accompanying drawing in which:

FIG. 1 is a front elevational cross section of a container-dispenser according to the invention.

FIG. 2 is an enlarged, perspective view of a capsule according to the invention, partially cut away to show detail.

FIG. 3 is an enlarged exploded cross sectional view of the neck portion of the container-dispenser of FIG. 1.

FIG. 4 is an enlarged cross sectional view of the neck portion of the container-dispenser of FIG. 1 with the closure cap partially applied.

DESCRIPTION OF PREFERRED EMBODIMENTS

Figure 5:
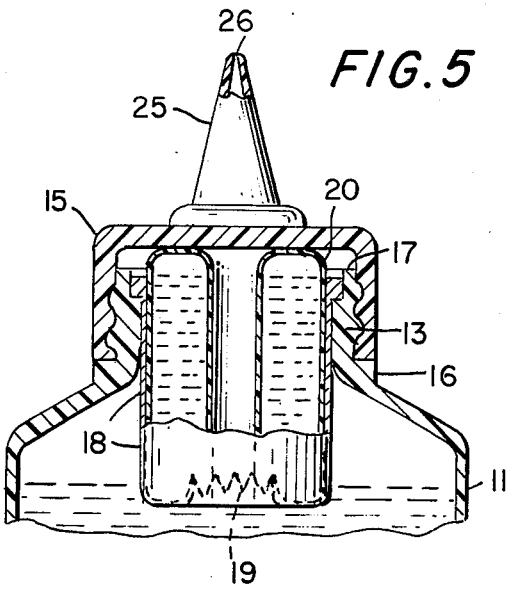
FIG. 5 is a cross sectional view of the neck portion of an alternate embodiment of the container-dispenser of the invention.

Referring to FIG. 1 of the drawing, the dispensing container of the invention is shown to include a bottle 10 or other hollow vessel having a body portion 11 for containing a diluent material 12, such as water, and a neck portion 13 having screw threads 14 on its outside surface for engaging the inner screw threads of closure cap 15, which is adapted to seal the open end of the neck portion 13 of the bottle 10. The closure cap 15 seats against the shoulder 16 disposed at the juncture of the body and neck portions of the bottle and can also seat against the outer rim 17 of the neck portion 13. However, and in accordance with a specific aspect of the invention, the closure cap may seat only against the shoulder 16 when the concentrate capsule is designed to protrude beyond the rim 17 when fully seated as shown in FIG. 5.

The neck portion 13 of the bottle 10 includes a cradle 18 attached to its inner surface and extending downwardly into the body portion 11 of the bottle. The cradle 18 terminates in upwardly extending puncturing means 19, typically in the form of a plurality of pointed projections in a circular saw tooth configuration.

A capsule of concentrated material 20, having an outside diameter slightly smaller than the inside diameter of the neck portion 13 is provided. The capsule 20 has the cross sectional configuration of a doughnut or a ring and includes an annular compartment 21 for the storage of the concentrated substance, typically a liquid, such as a detergent solution. A central passageway 22 passes through the capsule and provides a conduit for the dip tube 23 to extend from the hand pump 24 to the bottom region of the bottle. The capsule 20 has a frangible bottom wall adapted to be pierced by puncturing means 19 in response to downward axial movement of the closure cap 15. The remainder of the capsule 20, including the top wall can be substantially less frangible than the bottom wall.

The capsule 20 can be and preferably is injection molded from a plastic material such as polyethylene, polyvinyl chloride or many other suitable materials. The capsule is typically made in two sections with the top and side walls forming an integral blow molded unit and the frangible bottom wall being a thin plastic or cellulosic film either heat sealed or adhesively attached to the bottom of the side walls. In producing capsules, the integral top and side wall section is first blow molded. The concentrate solution is then supplied to the annular compartment 21 and the frangible bottle wall, comprising a thin film membrane, is heat sealed or adhesively secured over the open end of the capsule.

Figure 6:
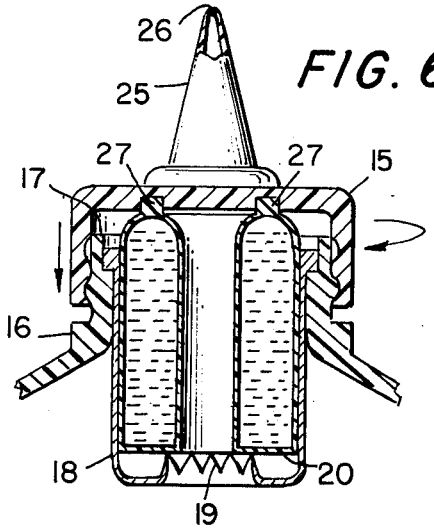
FIG. 6 is a cross sectional view of the neck portion of a further alternate embodiment of the container-dispenser of the invention.

Alternately, and as shown in FIGS. 5 and 6 of the drawing, a squirt nozzle 25 having a dispensing opening 26 can be used instead of the hand pump 24. When a squirt nozzle 25 is used in place of the hand pump 24 the walls of the bottle 11 should be flexible enough to permit the liquid contents to be expelled in response to finger pressure applied against opposing sides of the bottle.

As shown in FIG. 5, the capsule 20 can and preferably does protrude beyond the rim 17 of the neck portion 13 of the bottle when the cap 15 is seated against the shoulder 16. The protrusion of the capsule provides a surface which can be conveniently grasped by the consumer in removing a spent capsule from the container after use.

In any case, and according to a specific important aspect of the invention, the height or longitudinal dimension A of the capsule (see FIG. 3) should be greater than the distance (a) from the top of the projections 19 to the rim 17 of the neck portion 13 of the bottle. Most preferably the dimension A is chosen to result in the capsule extending beyond the rim 17 when the cap 15 is fully seated and the bottom of the capsule is punctured.

Figure 7:
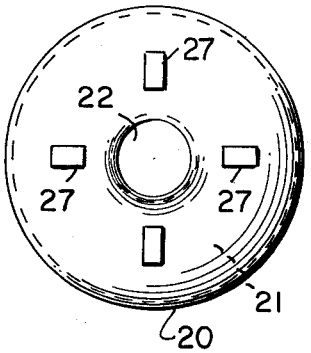
FIG. 7 is a top plan view of the concentrate capsule shown in FIG. 6.

Referring now to FIGS. 6 and 7, an alternate embodiment of the invention is shown. The capsule 20 can include a plurality of projections 27 extending from its upper surface and adapted to engage and mate with corresponding recesses in the upper surface of the closure cap 15. The engagement between projections 27 and the corresponding recesses causes the capsule 20 to rotate with the cap 15 while the cap is being screwed onto the neck portion 13 causing the bottom of the capsule to rotate on the puncturing means 19 while it is being punctured. As a result, the bottom of the capsule is ruptured to a greater extent thereby insuring that substantially all of the concentrate is released into the diluent 12.

Figure 8:
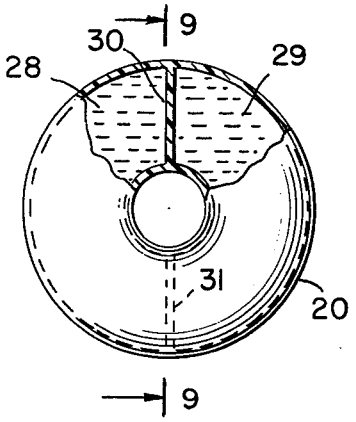
FIG. 8 is a partially cut away top plan view of an alternate capsule according to the invention.
Figure 9:
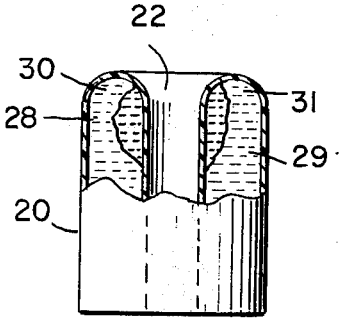
FIG. 9 is a cross sectional view of the capsule shown in FIG. 8, taken along line 9—9 of FIG. 8.

Referring now to FIGS. 8 and 9 of the drawing, a further embodiment of the invention is illustrated. The capsule 20 shown in FIG. 8 includes a plurality of compartments 28, 29 for containing separate concentrated solutions that are to be combined with the diluent 12. The compartments 28, 29 are separated by partitions 30, 31 and are punctured simultaneously by puncturing means 19 when the closure cap 15 is applied.

The invention provides an advantageous, inexpensive, safe and easy to use container dispenser for combining and dispensing two or more components of a multi-component system before use. The container or bottle is reuseable and the capsules are easily removed and replaced when exhausted. The bottle need only be purchased once and various types of dispensing means such as the hand pump and squirt nozzle shown and described may be used therewith.

The foregoing description is directed to various preferred embodiments of the invention and shall not be deemed limiting of the invention, the full scope of which is defined by the following claims.

I claim:

1. A container for diluting and dispensing in diluted form a concentrated substance provided in a capsule having an annular storage compartment, a central passageway, a frangible bottom wall and a predetermined height dimension in a direction parallel to the axis of said central passageway, said container comprising, in combination, a. a hollow vessel having a neck portion terminating in a annular rim,
b. a closure cap having an inner threaded surface,
c. said neck portion having an outer threaded surface adapted to mate with said inner threaded surface of said neck portion,
d. a cradle disposed in said neck portion below said annular rim, for supporting said capsule,
e. said cradle including puncturing means projecting from said cradle toward said annular rim and terminating below said annular rim,
f. the distance from the terminus of said puncturing means to said annular rim being less than said predetermined height dimension of said capsule,
g. dispensing means disposed in said closure cap for expelling the contents of said vessel through said central passageway,
h. said puncturing means being adapted to pierce the frangible bottom wall of said capsule in response to downward movement of said closure cap on said neck portion of the vessel, thereby releasing said concentrated substance into said hollow vessel, said capsule including a first engagement means and said closure cap including a second engagement means coacting with said first engagement means during mounting of the closure cap on said vessel to rotate said capsule in response to rotation of said cap.

2. The container of claim 1 wherein said puncturing means includes a series of projections in a circular saw tooth configuration.

3. The container of claim 1 wherein said capsule protrudes beyond said annular rim when said closure cap is in a fully seated position.

4. The container of claim 1 wherein said capsule includes a plurality of separate longitudinal compartments.

5. The container of claim 1 wherein the upper surface of said capsule includes a plurality of spaced projections and the inner top surface of said closure cap includes a series of corresponding recesses adapted to receive said projections.

6. In combination, a container for diluting and dispensing in diluted form a concentrated substance and a capsule containing said concentrated substance, said capsule having a annular storage compartment defined by inner and outer side walls, a top wall, a bottom wall, and a predetermined height dimension, said bottom wall being frangible, said top and inner and outer side walls being substantially less frangible than said bottom wall, and said container comprising:

a. hollow vessel terminating at its open end in an annular rim,
b. a closure cap having an inner threaded surface,
c. said annular rim including an outer threaded surface adapted to mate with said inner threaded surface of said closure cap,
d. a cradle disposed below said open end, for supporting said capsule,
e. said cradle including capsule puncturing means,
f. the distance from the terminus of said puncturing means to said open end being less than said predetermined height dimension of said capsule, and
g. means for dispensing the contents of said vessel through said closure cap,
h. said puncturing means including at least one projection disposed to pierce said bottom wall between said inner and outer side walls thereby releasing said concentrated substance into said hollow vessel.

* * * * *